US006432600B2

(12) United States Patent
Suwa et al.

(10) Patent No.: US 6,432,600 B2
(45) Date of Patent: Aug. 13, 2002

(54) TONER FOR ELECTROPHOTOGRAPHY

(75) Inventors: Yoshihito Suwa, Shizuoka; Hisashi Okuyama; Yasumasa Horibe, both of Kyoto, all of (JP)

(73) Assignees: Tomoegawa Paper Co., Ltd., Tokyo; Shimadzu Corporation, Kyoto, both of (JP)

( * ) Notice: Subject to any disclaimer, the term of this patent is extended or adjusted under 35 U.S.C. 154(b) by 0 days.

(21) Appl. No.: 09/730,736

(22) Filed: Dec. 7, 2000

(30) Foreign Application Priority Data

Dec. 10, 1999 (JP) ..... 11-352412

(51) Int. Cl.[7] ..... G03G 9/087
(52) U.S. Cl. ..... 430/109.1
(58) Field of Search ..... 430/109.1, 109.4

(56) References Cited

U.S. PATENT DOCUMENTS

| | | | | |
|---|---|---|---|---|
| 5,004,664 A | | 4/1991 | Fuller et al. | |
| 5,208,131 A | | 5/1993 | Felder et al. | |
| 5,387,665 A | | 2/1995 | Misawa et al. | |
| 5,667,927 A | | 9/1997 | Kubota et al. | |
| 5,760,118 A | * | 6/1998 | Sinclair et al. | 524/306 |
| 5,965,313 A | | 10/1999 | Mizutani et al. | 430/110 |

FOREIGN PATENT DOCUMENTS

| | | |
|---|---|---|
| EP | 0 640 882 B1 | 3/1995 |
| EP | 0 640 882 | 3/1995 |
| JP | 5-508940 | 12/1993 |
| JP | 6-502926 | 3/1994 |
| JP | 6-308765 | 11/1994 |
| JP | 2909873 | 4/1999 |
| JP | 11-119471 | 4/1999 |
| WO | WO 92/01245 | 1/1992 |
| WO | 92/01245 | 1/1992 |
| WO | 92/01246 | 1/1992 |

OTHER PUBLICATIONS

Patent Abstracts of Japan 06–308765 (Nov. 1994) Mitsui Toatsu Chem Inc.
Patent Abstracts of Japan 07–120975 (May 1995) Tomoegawa Paper Co. Ltd and Sshimadzu Corp.

* cited by examiner

*Primary Examiner*—John Goodrow
(74) *Attorney, Agent, or Firm*—Nixon & Vanderhye P.C.

(57) ABSTRACT

Toner used for electrophotography includes a polylactic acid type biodegradable resin and a terpene-phenol copolymer. The molar concentration of one of the L-lactic acid units and D-lactic acid units in a lactic acid component of the polylactic acid type biodegradable resin is in the range between about 75 mol % and about 98 mol %. The terpene-phenol copolymer may include at least one composition selected from the group consisting of: (a) cyclic terpene-phenol copolymer, prepared by copolymerizing cyclic terpene and phenol; (b) cyclic terpene/phenol (1:2 molar ratio) addition product, prepared by adding two molecules of phenol to one molecule of cyclic terpene (c) polycyclic terpene/phenol (1:2 molar ratio) addition product, prepared by a condensation reaction of the cyclic terpene/phenol (1:2 molar ratio) addition product with one of aldehyde and ketone, and (d) polycyclic terpene/phenol (1:1 molar ratio) addition product, prepared by a condensation reaction of a cyclic terpene/phenol (1:1 molar ratio) addition product with one of aldehyde and ketone. The toner of the invention is applicable to a full-color toner.

11 Claims, No Drawings

TONER FOR ELECTROPHOTOGRAPHY

BACKGROUND OF THE INVENTION

1. Field of the Invention

The present invention relates to a toner for electrophotography. More specifically, the present invention relates to a binder resin having high electric power efficiency and excellent resin strength, which may be used for a toner for electrophotography.

2. Description of Related Art

Recently, copying machines and printers which utilize an electrophotography system have been widely used in many places and, as their applications increase, the demand for low electric power consumption and easy treatment of a waste toner has been increased. As for the toners used for electrophotography, one that has an excellent fixing property to a transfer medium even at low fixing temperatures and no need to be treated as a waste product after its use has been awaited. Also, toners that generates no hazardous volatile gases during the thermal fixing process has been demanded.

Conventionally, in order to improve the fixing strength of a toner for electrophotography, a binder resin having low molecular weight has been utilized. Also, attempts have been made to lower the glass transition temperature of the toner to decrease the softening temperature thereof.

However, when a binder resin of low molecular weight is used for toners, although the softening temperature of the toner is lowered, its melting viscosity is also lowered which causes a decrease in durability and an offset for a thermal fixing roller. In order to eliminate the occurring of offset, the addition of releasing agents such as waxes having a low melting point has been examined. However, such effect can only be achieved with sacrifice of durability such as fluidity, anti-fusing property, and anti-spent property of toner.

Also, although a styrene-acryl copolymer has been conventionally used as a binder resin for toners, there is a problem that hazardous chemicals such as styrene and xylene used in the polymerization process remain in the final product. In order to solve this problem, the efficiency of the polymerization process has been increased and the washing process of the resin after polymerization has been intensified. However, in consideration of their performance and required costs, these cannot be regarded as the best ways.

Moreover, if polyester resin is used, the fixing property of the toner at low temperatures is insufficient.

Further, although waste toner from copying machines and printers of the electrophotography systems are being collected by contractors recently, most of the collected toner is incinerated or buried as industrial wastes. Also, the handling of an all-in-one type toner cartridge containing a developer and a waste toner box is troublesome when it is recycled.

In addition, toners used for full-color printers which have rapidly increased in popularity are sensitive to mechanical stress due to an increase in printing process speed. Especially, sharp melt type toners which are designed to attain high gloss have a large problem that they fuse with the carrier and other members such as the electrocharging blade.

Also, the transparency of polyester is not sufficient and it cannot satisfactorily be applied to a full-color toner which requires a high transparency.

The purposes of the present invention are to solve the above-mentioned problems associated with conventional toners for electrophotography and provide a toner for electrophotography having a high fixing strength at a low temperature, which does not generate hazardous volatile gases. The toner for electrophotography of the present invention also has a good adaptability for full-color toners and is designed in consideration of the environmental influence.

SUMMARY OF THE INVENTION

Accordingly, the present invention relates to a toner for electrophotography including a polylactic acid type biodegradable resin and a terpene-phenol copolymer as a binder resin.

With regard to the polylactic acid type biodegradable resin, the molar concentration of one of L-lactic acid unit and D-lactic acid unit in a lactic acid component of the polylactic acid type biodegradable resin is in the range between about 75 mol % and about 98 mol %.

The terpene-phenol copolymer includes at least one composition selected from the group consisting of: (a) cyclic terpene-phenol copolymer, prepared by copolymerizing cyclic terpene and phenol; (b) cyclic terpene/phenol (1:2 molar ratio) addition product, prepared by adding two molecules of phenol to one molecule of cyclic terpene; (c) polycyclic terpene/phenol (1:2 molar ratio) addition product, prepared by a condensation reaction of a cyclic terpene/phenol (1:2 molar ratio) addition product with one of aldehydes and ketones; and (d) polycyclic terpene/phenol (1:1 molar ratio) addition product, prepared by a condensation reaction of a cyclic terpene/phenol (1:1 molar ratio) addition product with one of aldehydes and ketones.

The present invention also provides a toner for electrophotography, wherein the ratio of the polylactic acid type biodegradable resin with respect to the terpene-phenol copolymer is in the range between about 80:20 and about 20:80.

The present invention also provides a toner for electrophotography, wherein the melting start temperature of the toner is about 110° C. or lower.

The present invention also provides a full-color toner, including: a polylactic acid type biodegradable resin; and a terpene-phenol copolymer.

The present invention also provides a full-color toner, wherein the molar concentration of one of L-lactic acid unit and D-lactic acid unit in a lactic acid component of the polylactic acid type biodegradable resin is in the range between about 75 mol % and about 98 mol %.

The present invention also provides a full-color toner, wherein the terpene-phenol copolymer includes at least one composition selected from the group consisting of: (a) cyclic terpene-phenol copolymer, prepared by copolymerizing cyclic terpene and phenol; (b) cyclic terpene/phenol (1:2 molar ratio) addition product, prepared by adding two molecules of phenol to one molecule of cyclic terpene; (c) polycyclic terpene/phenol (1:2 molar ratio) addition product, prepared by a condensation reaction of a cyclic terpene/phenol (1:2 molar ratio) addition product with one of aldehydes and ketones; and (d) polycyclic terpene/phenol (1:1 molar ratio) addition product, prepared by a condensation reaction of a cyclic terpene/phenol (1:1 molar ratio) addition product with one of aldehydes and ketones.

The present invention also provides a full-color toner, wherein the ratio of the polylactic acid type biodegradable resin with respect to the terpene-phenol copolymer is in the range between about 80:20 and about 20:80.

The present invention also provides a full-color toner, wherein the melting start temperature of the toner is about 110° C. or lower.

The toner for electrophotography according to the present invention has an excellent fixing strength at low temperatures, anti-offset property, anti-filming property on a photosensitive member, and anti-fusing property on electrocharging members. Also, the transparency of the toner for electrophotography according to the present invention is applicable to a full-color toner. Moreover, in the process for preparing the toner for electrophotography of the present invention and in the fixing process using the toner of the present invention, hazardous gases such as styrene and xylene are not generated. Further, according to the present invention, the durability of the toner is increased and yet its fluidity, anti-fusing property and anti-spent property are not deteriorated. In addition, the toner for electrophotography according to the present invention has an excellent cost efficiency.

DETAILED DESCRIPTION OF THE INVENTION

Hereinafter the toner for electrophotography according to the present invention will be described in detail.

In the toner for electrophotography of the present invention, it is essential that the toner contains a polylactic acid type biodegradable resin and a terpene phenol copolymer.

The term "a polylactic acid type biodegradable resin" used in this specification means a biodegradable resin having a lactic acid component as its main component, and includes a polylactic acid homopolymer, a lactic acid copolymer and a blend polymer.

The weight average molecular weight of the polylactic acid type biodegradable resin is generally between 50,000 and 500,000.

Also, the mole fraction of L-lactic acid units and D-lactic acid units in the polylactic acid type biodegradable resin can be between 100:0 and 0:100.

Moreover, it is preferable that one of the L-lactic acid units and the D-lactic acid units is contained in an amount between about 75 mol % and 98 mol % in order to obtain a high fixing strength and a good fluidity at a lower temperature range. It is more preferable that one of the L-lactic acid units and the D-lactic acid units is contained in the amount between 80 mol % and 95 mol %. If the amount is less than 75 mol %, the polylactic acid type biodegradable resin is in its amorphous state and the fixing strength thereof is lowered. This tends to become a cause for an occurring of the offset. On the other hand, if the amount is larger than 98 mol %, the polylactic acid type biodegradable resin becomes highly crystalline and its melting start temperature is increased. Also, a sharp-melt is caused at the melting point of the polylactic acid type biodegradable resin, which tends to become a cause of the fusing with the carrier and other members such as the electrocharging blade.

Lactic acid copolymer may be prepared by copolymerizing a lactic acid monomer or a lactide with other copolymerizable components. Examples of such copolymerizable components include dicarboxylic acids, polyalcohols, hydroxy carboxylic acids, lactones, and various polyesters, polyethers, and polycarbonates having these components having more than two functional groups which may form an ester bonding.

Examples of the dicarboxylic acids include succinic acid, adipic acid, azelaic acid, sebacic acid, telephthalic acid, and isophthalic acid.

Examples of the polyalcohols include aromatic polyalcohols prepared by such methods as an addition reaction of ethylene oxide to bisphenol, aliphatic polyalcohols such as ethylene glycol, propylene glycol, butanediol, hexanediol, octanediol, glycerin, sorbitol, trimethylol propane, and neopentyl glycol, and ether glycols such as diethylene glycol, triethylene glycol, polyethylene glycol, and polypropylene glycol.

Examples of the hydroxy carboxylic acids include glycol acid, hydroxy butyl carboxylic acid and acids described in Japanese Unexamined Patent Application, First Publication No. 6-184417.

Examples of lactones include glycoride, ε-caprolactone glycoride, ε-caprolactone, β-propiolactone, δ-butyrolactone, β- or γ-butyrolactone, pivarolactone, and δ-valerolactone.

The polylactic acid type biodegradable resin may be prepared by using conventional methods. For instance, it may be synthesized by a dehydration and condensation reaction of lactic acid monomers or a ring-opening polymerization of lactide which is cyclic dimer of lactic acid as described in Japanese Unexamined Patent Application, First Publication No. 7-33861, Japanese Unexamined Patent Application, First Publication No. 59-96123, and Koubunshi Touronkai Yokousyu Vol. 44, pp. 3198–3199.

In the dehydration and condensation process, any one of L-lactic acid, D-lactic acid, DL-lactic acid, and a mixture thereof may be used. Also, when the ring-opening polymerization reaction is carried out, any one of L-lactid, D-lactide, DL-lactide, and a mixture thereof may be employed.

Processes for synthesizing, purifying, and polymerizing lactides are described in, for instance, U.S. Pat. No. 4,057,537, EP Application No. 261,572, Polymer Bullein, vol. 14, pp. 491–495 (1985), and Makromol Chem., vol. 187, pp. 1611–1628 (1986).

The catalysts which may be used in the above polymerization reaction are not particularly limited and known catalysts generally used for lactic acid polymerization may be utilized. Examples of such catalysts include, for instance, tin compounds such as tin lactate, tin tartrate, tin dicaprylate, tin dilaurylate, tin dipalmitate, tin distearate, tin dioleate, α-tin naphthoate, β-tin naphthoate, tin octylate, tin powder, and tin oxide, zinc compounds such as zinc powder, halogenized zinc, zinc oxide, and organic zinc compounds, titanium compounds such as tetra-propyl titanate, zirconium compounds such as zirconium isopropoxide, antimony compounds such as antimony oxide, bismuth compounds such as bismuth oxide (III), and aluminum compounds such as aluminum oxide and aluminum isopropoxide.

Among the above catalysts, interalia, tin and tin compounds are preferable in terms of their activity. The amount of the catalysts used, for instance, in the open-ring polymerization reaction, is in the range between about 0.001 and about 5% by weight with respect to lactide.

In general, depending on the type of the catalyst used, the polymerization reaction may be carried out at a temperature in the range between about 100 and 220° C. Also, it is preferable to perform two-step polymerization as disclosed in Japanese Unexamined Patent Application, First Publication No. 7-247345.

The terpene phenol copolymer, which is one of the essential components of the present invention, may be in various forms such as a low molecular weight compound, oligomer, and polymer. Also, it can be a crystalline compound having a melting point or a non-crystalline (amorphous) compound having no melting point. Among them, especially, any one of the terpene phenol copolymers (a)–(d) described below is preferable:

(a) cyclic terpene-phenol copolymer, prepared by copolymerizing cyclic terpene and phenol;

(b) cyclic terpene/phenol (1:2 molar ratio) addition product, prepared by adding two molecules of phenol to one molecule of cyclic terpene;

(c) polycyclic terpene/phenol (1:2 molar ratio) addition product, prepared by a condensation reaction of the cyclic terpene/phenol (1:2 molar ratio) addition product with aldehydes or ketones; and (d) polycyclic terpene/phenol (1:1 molar ratio) addition product, prepared by a condensation reaction of the cyclic terpene/phenol (1:1 molar ratio) addition product with aldehydes or ketones.

The cyclic terpene-phenol copolymer described in (a) may be prepared by reacting a cyclic terpene compound with a phenol under the presence of a Friedel-Crafts catalyst.

The cyclic terpene/phenol (1:2 molar ratio) addition product described in (b) may be prepared by reacting a cyclic terpene compound with a phenol under the presence of an acidic catalyst.

The polycyclic terpene/phenol (1:2 molar ratio) addition product described in (c) may be prepared by a condensation reaction of the cyclic terpene/phenol (1:2 molar ratio) addition product with aldehydes or ketones.

The polycyclic terpene/phenol (1:1 molar ratio) addition product described in (d) may be prepared by reacting a cyclic terpene with a phenol under the presence of an acidic catalyst to produce a cyclic terpene/phenol (1:1 molar ratio) addition product and subjecting the obtained 1:1 addition product to a condensation reaction with aldehydes or ketones.

These terpene-phenol copolymer may be used solely or in combination with two or more other copolymers.

The terpene compound for preparing the terpene-phenol copolymer used in the present invention may be a monocyclic terpene compound or a bicyclic terpene compound. Non-limiting examples of such compounds include the following:

α-pinene, β-pinene dipentene, limonene, phellandrene, α-terpinen, γ-terpinen, terpinolene, 1,8-cinenole, 1,4-cineole, terpineole, camphene, tricyclene, paramenthene-1, paramenthene-2, paramenthene-3, paramentadiene, and carene.

On the other hand, non-limiting examples of the phenol material for preparing the terpene-phenol copolymer used in the present invention include: phenol, o-cresol, m-cresol, p-cresol, o-ethylphenol, m-ethylphenol, p-ethylphenol, o-butylphenol, m-butylphenol, p-butylphenol, 2,3-xylenol, 2,4-xylenol, 2,5-xylenol, 2,6-xylenol, 3,4-xylenol, 3,6-xylenol, p-phenylphenol, p-methoxyphenol, m-methoxyphenol, bisphenol-A, bisphenol-F, catechol, resorcinol, hydroquinone, and naphthol. These compounds may be used solely or in combination.

The copolymerization reaction of a cyclic terpene with a phenol to produce the cyclic terpene-phenol copolymer described in (a) above uses about 0.1–12 mol, preferably about 0.2–6 mole, of phenol with respect to one mole of cyclic terpene and subject the mixture to a reaction at about 0–120° C. for about 1–10 hours under the presence of a Friedel-Crafts catalyst. Examples of the Friedel-Crafts catalysts that may be employed include aluminum chloride and boron trifluoride or complex thereof. A reaction solvent such as an aromatic hydrocarbon is generally used. Examples of commercially available cyclic terpene/phenol copolymer prepared as above include "YS polystar-T-130", "YS polystar-S-145", "Mighty Ace G-150" produced by Yasuhara Chemical Co.

The addition reaction of one mole of a cyclic terpene with two moles of a phenol described in (b) above uses about 1–12 mol, preferably about 2–8 mol, of phenol with respect to one mole of cyclic terpene and subjects the mixture to a reaction at about 20–150° C. for about 1–10 hours under the presence of an acidic catalyst. Examples of such acidic catalyst include hydrochloric acid, sulfuric acid, phosphoric acid, polyphosphoric acid, boron trifluoride or its complex, cation-exchange resin, and activated clay. Although a reaction solvent need not be used, a solvent such as an aromatic hydrocarbon, alcohol, and ether may be utilized. Examples of a commercially available cyclic terpene/phenol (1:2 mol) addition product prepared as above include "YP-90" by Yasuhara Chemical Co.

Examples of the aldehydes or ketones used as a condensation agent to prepare the polycyclic terpene/phenol (1:2 mol) addition product described in (c) include: formaldehyde, paraformaldehyde, acetoaldehyde, propylaldehyde, benzaldehyde, hydroxybenzaldehyde, phenylacetoaldehyde, furfural, acetone, and cyclohexanone.

It is possible to add other phenols together with the cyclic terpene/phenol (1:2 molar ratio) addition product to carry out the condensation reaction. In such a case, the amount of the cyclic terpene/phenol (1:2 molar ratio) addition product is at least about 20% by weight, preferably 40% by weight, with respect to the total amount with the other phenol. If the ratio of the cyclic terpene/phenol (1:2) addition product is lower, a suitable polycyclic terpene/phenol (1:2) addition product may not be obtained.

The ratio of aldehyde or ketone with respect to the cyclic terpene/phenol (1:2) addition product and other phenols in the condensation reaction is about 0.1–2.0 mol, preferably 0.2–1.2 mol, and subjected to a reaction at about 40–200° C. for about 1–12 hours under the presence of an acidic catalyst. If the amount of the aldehyde or ketone is too large, the molecular weight of the resulting polycyclic terpene/phenol (1:2) addition product also becomes too large.

Examples of the acidic catalyst which may be used in the condensation reaction include: inorganic acids, such as hydrochloric acid, nitric acid, and sulfuric acid; and organic acids, such as formic acid, acetic acid, oxalic acid, and toluene sulfonic acid. The amount of the acidic catalyst used is 0.1–5 parts by weight with respect to 100 parts by weight of the cyclic terpene/phenol (1:2) addition product and other phenol. In the condensation reaction, an inert solvent such as aromatic hydrocarbons, alcohols, and ethers may be used.

In the addition reaction of one molecule of a cyclic terpene to one molecule of a phenol to prepare the cyclic terpene/phenol (1:1) addition product which is a precursor of the polycyclic terpene/phenol (1:1) addition product described in (d) above 0.5–6 mol, preferably 1–4 mol, of phenol is used relative to 1 mol of cyclic terpene, and the rection is carried out at about 20–150° C. for about 1–10 hours under the presence of an acidic catalyst. Examples of such an acidic catalyst include hydrochloric acid, sulfuric acid, phosphoric acid, polyphosphoric acid, boron trifluoride or its complex, a cation-exchange resin, and an activated clay. Although a reaction solvent need not be used, solvent such as an aromatic hydrocarbon, alcohol, and ether may be utilized. Examples of a commercially available cyclic terpene/phenol (1:1) addition product prepared as above include "YP-90LL" by Yasuhara Chemical Co.

The condensation reaction of the cyclic terpene/phenol (1:1) addition product with aldehydes or ketones to prepare the polycyclic terpene/phenol (1:1) addition product is carried out in the same manner as described in (c) above for the preparation of the polycyclic terpene/phenol (1:2) addition product. Examples of such commercially available products include "DLN-120" and "DLN-140" by Yasuhara Chemical Co.

In the toner for electrophotography according to the present invention, a blend of the above-mentioned polylactic acid type biodegradable resin and the terpene-phenol copolymer constitutes the binder resin as the main resin. The ratio of the polylactic acid type biodegradable resin with respect to the terpene-phenol copolymer is preferably in the range between about 80:20 and 20:80. If the amount of the polylactic acid type biodegradable resin exceeds these limits, the strength of the mixture becomes too strong and a pulverization classification thereof becomes difficult. Also, if the amount of the terpene-phenol copolymer exceeds these limits, the resulting toner becomes too fragile and the developing properties including its durability, are deteriorated. The ratio of the polylactic acid type biodegradable resin and the terpene-phenol copolymer, in order to obtain both of high productivity and quality of the product, is preferably between about 30:70 and 50:50.

The method for compounding the polylactic acid type biodegradable resin and terpene-phenol copolymer to the toner for electrophotography is not particularly limited.

For instance, after preparing a mixture resin of the polylactic acid type biodegradable resin and the terpene-phenol copolymer, the mixture may be subjected to a dry blending with other components such as a colorant, which will be described later, by using a mixer such as a Henschel mixer or a Super mixer and then to heat melt extruding by using a roll mill, a Bunbary mixer, or an uniaxial or biaxial extruder. The heat melt extruding process is generally carried out at the temperature in the range between about 120 and 220° C.

Also, it is possible to dry-blend the polylactic acid type biodegradable resin. terpene-phenol copolymer, and other components such as colorant by using a mixer such as a Henschel mixer or a Super mixer and then subjecting the resulting mixture to a melt-mixing using a roll mill, a Bunbary mixer, or an uniaxial or biaxial extruder.

Moreover, it is possible to add, if necessary, various additives to the toner for electrophotography according to the present invention, such as a known plasticizer, an antioxidant, a thermostabilizer, a photostabilizer, an ultraviolet ray absorbent, a pigment, a colorant, various fillers, an antistatic agent, a releasing agent, a flavor, a lubricant, a flame retardant, a foaming agent, an antibacterial-antifungal agent, and other nucleation agents.

Further, it is possible to blend several kinds of polylactic acid type biodegradable resins and/or terpene-phenol copolymers. In such a case, various properties of the toner, such as the anti-fusing property and the range of non-offset, may be optionally changed by adjusting the blend ratio of the two components.

In addition, it is preferable that the toner for electrophotography of the present invention has a melting start temperature of 110° C. or lower in order to realize a fixing process using as low a temperature and pressure as possible.

The term "melting start temperature" used in this specification means the temperature measured by using the following equipment and the measuring conditions. Note that the melting start temperature is a temperature at which the plunger starts to fall.

Measuring equipment: Flow Tester CFT-500D (Shimadzu Corporation) (constant load extruder type, capillary type rheometer)

| Measuring conditions: | |
|---|---|
| Plunger: | 1 $cm^2$ |
| Diameter of die: | 1 mm |
| Length of die: | 1 mm |
| Load: | 20 $kgF/cm^2$ |
| Preheating temperature: | 50–80° C. |
| Preheating time: | 300 sec |
| Rate of temperature increase: | 6° C./min |

It is important to select suitable materials and the mixing ratio of the polylactic acid type biodegradable resin and the terpene-phenol copolymer taking into account the thermal properties thereof in order to establish the melting start temperature of the toner for electrophotography at 110° C. or lower and maintain the strength of the resin to be suitable as a binder resin. Also the thermal properties of both of the resins are important to obtain both the sufficient fixing strength at low temperatures and a wide non-offset range since the molecular weight distribution of the polylactic acid type biodegradable resin and that of the terpene-phenol copolymer are basically quite narrow.

In the toner for electrophotography according to the present invention, such additives generally used as coloring agents, charge controlling agents, waxes, and other additives if necessary, may be added at a desired ratio.

Also, examples of the coloring agent include carbon black, monoazo type red pigments, disazo type yellow pigments, monoazo type yellow pigments, quinacridone type magenta pigments, copper phthalocyanine type cyan pigments, and anthraquinone type dyes.

Examples of the charge controlling agent include nigrosin type dyes, quaternary ammonium salts, monoazo type metal complex dyes, and boron type complex salts.

Examples of the other additives, which may be added if necessary, include releasing agents such as polyolefins such as polypropylene, Fischer-Tropsch waxes, and other natural waxes. Also, examples of external additives include hydrophobic silicas, titanium oxide, and silicone oils.

According to the toner for electrophotography of the present invention, it becomes possible to realize an excellent fixing property of the toner at low temperatures because a large amount of the terpene-phenol copolymer, which is effective for the fixing property of the toner at low temperatures though weak in strength as a resin, has become possible to be added due to the high resin strength of the polylactic acid type biodegradable resin. Also, hazardous gases such as styrene or xylene are not generated during thermal fixing process.

Moreover, the transparency of the polylactic acid type biodegradable resin and terpene-phenol copolymer is higher than that of polyester resins in general, and may be suitably applied to a full-color toner which requires high transparency.

According to the present invention, for all of the above reasons, it becomes possible to provide a toner for electrophotography which is safer to use and possesses better fixing property at low temperatures as compared with conventional products. The product of the present invention is also very suitable for application to a full-color toner.

EXAMPLES

Hereinafter, the present invention will be described based on examples. However, the examples are used only for explanation purposes and are not by any means to restrict the invention.

Example 1

| | | |
|---|---|---|
| Polylactic acid type biodegradable resin A | | 45.0 wt % |
| Molecular weight: | Mw = 125,000 | |
| | Mn = 57,000 | |
| Tg: | 53.2° C. | |
| Ti/Tm: | 153/170° C. | |
| L/D molar ratio: | L (mol %)/D (mol %) = 91.8 (mol %)/8.2 (mol %) | |
| Terpene-phenol copolymer A (cyclic terpene-phenol copolymer) | | 45.0 wt % |
| Molecular weight: | Mw = 600 | |
| Tg: | 69.5° C. | |
| Ti/Tm: | 92/111° C. | |
| Carbon Black | | 6.0 wt % |
| ("MA-100", Mitsubishi Chemical Corporation.) | | |
| Iron containing metallic dye | | 2.0 wt % |
| ("T-77", Hodogaya Chemical Co., Ltd.) | | |
| Polypropylene | | 2.0 wt % |
| ("Biscall 550p", Sanyo Chemical Industries) | | |

The above materials were mixed by using a Hensehel mixer and, after being subjected to a heat melt extruding process, the mixture is subjected to a pulverization and a classification process to obtain negatively charged toner powder having a volume average particle size of 10 $\mu$m. After that 0.6% by weight of hydrophobic silica ("R-972", Japan Aerosyl Co.) is attached to the surface of toner powder of 100% by weight by using the Henschel mixer to produce the toner for electrophotography of the present invention. The melting start temperature of thus obtained toner for electrophotography was 102° C.

Example 2

| | | |
|---|---|---|
| Polylactic acid type biodegradable resin A | | 18.0 wt % |
| Molecular weight: | Mw = 125,000 | |
| | Mn = 57,000 | |
| Tg: | 53.2° C. | |
| Ti/Tm: | 153/170° C. | |
| L/D molar ratio: | L (mol %)/D (mol %) = 91.8 (mol %)/8.2 (mol %) | |
| Terpene-phenol copolymer A (cyclic terpene-phenol copolymer) | | 72.0 wt % |
| Molecular weight: | Mw = 600 | |
| Tg: | 69.5° C. | |
| Ti/Tm: | 92/111° C. | |
| Carbon Black | | 6.0 wt % |
| ("MA-100", Mitsubishi Chemical Corporation.) | | |
| Iron containing metallic dye | | 2.0 wt % |
| ("T-77", Hodogaya Chemical Co., Ltd.) | | |
| Polypropylene | | 2.0 wt % |
| ("Biscall 550p", Sanyo Chemical Industries, Ltd.) | | |

The toner for electrophotography of the present invention was obtained in the same manner as described in Example 1. The melting start temperature of the thus obtained toner for electrophotography was 95° C.

Example 3

| | | |
|---|---|---|
| Polylactic acid type biodegradable resin A | | 72.0 wt % |
| Molecular weight: | Mw = 125,000 | |
| | Mn = 57,000 | |
| Tg: | 53.2° C. | |
| Ti/Tm: | 153/170° C. | |
| L/D molar ratio: | L (mol %)/D (mol %) = 91.8 (mol %)/8.2 (mol %) | |
| Terpene-phenol copolymer A (cyclic terpene-phenol copolymer) | | 18.0 wt % |

-continued

| | | |
|---|---|---|
| Molecular weight: | Mw = 600 | |
| Tg: | 69.5° C. | |
| Ti/Tm: | 92/111° C. | |
| Carbon Black | | 6.0 wt % |
| ("MA-100", Mitsubishi Chemical Corporation.) | | |
| Iron containing metallic dye | | 2.0 wt % |
| ("T-77", Hodogaya Chemical Co.. Ltd.) | | |
| Polypropylene | | 2.0 wt % |
| ("Biscall 550p", Sanyo Chemical Industries, Ltd.) | | |

The toner for electrophotography of the present invention was obtained in the same manner as described in Example 1. The melting start temperature of the thus obtained toner for electrophotography was 109° C.

Example 4

| | |
|---|---|
| Polylactic acid type biodegradabie resin A | 22.5 wt % |
| Molecular weight: | Mw = 125,000 |
| | Mn = 57,000 |
| Tg: | 53.2° C. |
| Ti/Tm: | 153/170° C. |
| L/D molar ratio: L (mol %)/ | |
| D (mol %) = 91.8 (mol %)/8.2 (mol %) | |
| Polylactic acid type biodegradable resin B | 22.5 wt % |
| Molecular weight: | Mw = 120,000 |
| | Mn = 48,000 |
| Tg: | 51.7° C. |
| Ti/Tm: | 104/–° C. |
| L/D molar ratio: L (mol %)/ | |
| D (mol %) = 81.0 (mol %)/19.0 (mol %) | |
| Terpene-phenol copolymer A | |
| (cyclic terpene-phenol copolymer) | 22.5 wt % |
| Molecular weight: | Mw = 600 |
| Tg: | 69.5° C. |
| Ti/Tm: | 92/111° C. |

Terpene-phenol copolymer B (cyclic terpene/phenol (1 mol/2 mol) addition product obtained by adding 2 molecules of phenol to 1 molecule of cyclic terpene compound)

| | |
|---|---|
| | 22.5 wt % |
| Molecular weight: | Mw = 700 |
| Tg: | 95.5° C. |
| Ti/Tm: | 110/145° C. |
| Carbon Black | 6.0 wt % |
| ("MA-100", Mitsubishi Chemical Corporation.) | |
| Iron containing metallic dye | 2.0 wt % |
| ("T-77", Hodogaya Chemical Co.. Ltd.) | |
| Polypropylene | 2.0 wt % |
| ("Viscol 550 p", Sanyo Chemical Industries, Ltd.) | |

The toner for electrophotography of the present invention was obtained in the same manner as described in Example 1. The melting start temperature of the thus obtained toner for electrophotography was 92° C.

Example 5

| | | |
|---|---|---|
| Polylactic acid type biodegradable resin A | | 44.7 wt % |
| Molecular weight: | Mw = 125,000 | |
| | Mn = 57,000 | |
| Tg: | 53.2° C. | |
| Ti/Tm: | 153/170° C. | |
| L/D molar ratio: | L (mol %)/D (mol %) = 91.8 (mol %)/8.2 (mol %) | |

-continued

| | |
|---|---|
| Terpene-phenol copolymer A (cyclic terpene-phenol copolymer) | 40.0 wt % |
| Molecular weight: Mw = 600 | |
| Tg: 69.5° C. | |
| Ti/Tm: 92/111° C. | |
| Magenta master batch | 13.3 wt % |
| ("Toner Magenta E02", Clariant (Japan) K. K.) | |
| A magenta master batch was prepared by heating and dispersing 70% by weight of polylactic acid type biodegradable type resin A and 30% by weight of Toner Magenta E02 by using a two-roller dispersing device. | |
| Boron complex salt | 2.0 wt % |
| ("LR-147", Japan Carlit Co., Ltd.) | |

The toner for electrophotography of the present invention was obtained using the above-mentioned materials in the same manner as described in Example 1. The melting start temperature of the thus obtained toner for electrophotography was 92° C.

Comparative Example 1

| | |
|---|---|
| Styrene-Acrylic acid ester copolymer A | 90.0 wt % |
| (Monomer composition: styrene/butyl acrylate) | |
| Molecular weight: Mw = 226,000 | |
| Mn = 3,680 | |
| Tg: 60.4° C. | |
| Ti/Tm: 115/141° C. | |
| Carbon Black | 6.0 wt % |
| ("MA-100", Mitsubishi Chemical Corporation.) | |
| Iron containing metallic dye | 2.0 wt % |
| ("T-77", Hodogaya Chemical Co., Ltd.) | |
| Polypropylene | 2.0 wt % |
| ("Biscall 550p", Sanyo Chemical Industries, Ltd.) | |

A comparative toner for electrophotography was obtained using the above-mentioned materials in the same manner as described in Example 1. The melting start temperature of the thus obtained toner for electrophotography was 112° C.

Comparative Example 2

| | |
|---|---|
| Polyester resin A | 90.0 wt % |
| (Monomer composition: terephthalic acid/trimellitic acid/ethylene glycol/bisphenol-A (EO)/bisphenol-A (PO)) | |
| Molecular weight: Mw = 71,100 | |
| Mn = 3,430 | |
| Tg: 60.8° C. | |
| Ti/Tm: 124/161° C. | |
| Carbon Black | 6.0 wt % |
| ("MA-100", Mitsubishi Chemical Corporation.) | |
| Iron containing metallic dye | 2.0 wt % |
| ("T-77", Hodogaya Chemical Co., Ltd.) | |
| Polypropylene | 2.0 wt % |
| ("Biscall 550p", Sanyo Chemical Industries, Ltd.) | |

A comparative toner for electrophotography was obtained using the above-mentioned materials in the same manner as described in Example 1. The melting start temperature of the thus obtained toner for electrophotography was 106° C.

Comparative Example 3

| | |
|---|---|
| Polylactic acid type biodegradable resin A | 90.0 wt % |
| Molecular weight: Mw = 125,000 | |
| Mn = 57,000 | |
| Tg: 53.2° C. | |
| Ti/Tm: 153/170° C. | |
| L/D molar ratio: L (mol %)/D (mol %) = 91.8 (mol %)/8.2 (mol %) | |
| Carbon Black | 6.0 wt % |
| ("MA-100", Mitsubishi Chemical Corporation.) | |
| Iron containing metallic dye | 2.0 wt % |
| ("T-77", Hodogaya Chemical Co., Ltd.) | |
| Polypropylene | 2.0 wt % |
| ("Biscall 550p", Sanyo Chemical Industries, Ltd.) | |

An attempt was made to obtain a comparative toner for electrophotography by using the above-mentioned materials in the same manner as described in Example 1. However, the obtained composition could not be pulverized and the experiment could not be continued.

Comparative Example 4

| | |
|---|---|
| Terpene-phenol copolymer A (cyclic terpene-phenol copolymer) | 90.0 wt % |
| Molecular weight: Mw = 600 | |
| Tg: 69.5° C. | |
| Ti/Tm: 92/111° C. | |
| Carbon Black | 6.0 wt % |
| ("MA-100", Mitsubishi Chemical Corporation.) | |
| Iron containing metallic dye | 2.0 wt % |
| ("T-77", Hodogaya Chemical Co., Ltd.) | |
| Polypropylene | 2.0 wt % |
| ("Biscall 550p", Sanyo Chemical Industries, Ltd.) | |

A comparative toner for electrophotography was obtained using the above-mentioned materials in the same manner as described in Example 1. The melting start temperature of the thus obtained toner for electrophotography was 93° C.

Comparative Example 5

| | |
|---|---|
| Polyester resin B | 84.7 wt % |
| (Monomer composition: terephthalic acid/trimellitic acid/ethylene glycol/bisphenol-A (EO)/bisphenol-A (PO)) | |
| Molecular weight: Mw = 9,800 | |
| Mn = 3,230 | |
| Tg: 61.8° C. | |
| Ti/Tm: 93/110° C. | |
| Magenta master batch | 13.3 wt % |
| ("Toner Magenta E02", Clariant (Japan) K. K.) | |
| The magenta master batch was the same as the one used in Example 5. | |
| Boron complex salt | 2.0 wt % |
| ("LR-147", Japan Carlit Co., Ltd.) | |

A comparative toner for electrophotography was obtained using the above-mentioned materials in the same manner as described in Example 1. The melting start temperature of the thus obtained toner for electrophotography was 92° C.

The following tests were performed on the above-mentioned Examples and Comparative Examples.

(1) Fixing Strength

A two-components developer was prepared by mixing 95 parts by weight of a ferrite carrier having no resin coating ("FL95-1530", Powder Tech Co.) with 5 parts by weight of the toner for electrophotography obtained in each of Examples and Comparative Examples. Then, using the thus prepared developer, a non-fixed pattern of patch of solid fill was formed on a transfer paper of A4 size with various amounts of the developer.

After that the non-fixed pattern was fixed on the paper by using an external fixing device including a thermal fixing roller having a surface layer made of Teflon (polytetrafluoroethylene) which rotates together with a pressure fixing roller having a surface layer made of silicone rubber. The roller pressure and the roller speed of the device were adjusted to be 1 Kg/cm$^2$ and 60 mm/sec, respectively. The temperatures of the surface of the thermal fixing roller were 125, 135, and 145° C., respectively.

The fixed pattern was erased by using a sand rubber eraser (a product of Lion Office Products Co.), which was contacted with the pattern image at an angle of 45° and reciprocated on the image three times at an applied pressure of 1 Kg. The ratio of fixing was calculated from the difference in image density of the pattern before and after the erasing process.

(2) Offset Property

A non-fixed image of 3 cm by 3 cm (length by width) was fixed on a transfer paper of A4 size by using each of the developers described in the above-mentioned (1) and increasing the temperature, in a stepwise manner, of the surface of the thermal fixing roller of the external fixation device. It was observed whether black spots were generated on a space of the transfer paper due to offset. The non-offset temperature range, which is defined as the temperature range between the disappearance of low temperature offset and the appearance of high temperature offset, was measured and evaluated.

(3) Print Durability

Using a developer including the toner for electrophotography obtained in Examples 1–4 and Comparative Examples 1 and 2 and a copying machine ("AR-5130", by Sharp Corporation), a test was conducted to carry out continuous copying of 50,000 sheets and the image density (ID) and background (also called "Jikaburi", BG) of the initial sheet and the last sheet were measured and compared. The blackened portion of the copied A4 paper was 10%. A reflection densitometer ("RD-914", Macbeth Co.) was used to measure the image density and a color-difference meter ("Model Z-1001 DP", Nihon Denshoku Kogyo Co.) was used to measure the background.

(4) Anti-spent and Anti-fusing Properties

The amount of spent of carrier after the 50,000 sheets of copying process was measured for the product prepared in Examples 1–4 and Comparative Examples 1 and 2. The evaluation of the full-color toners of Example 5 and Comparative Example 5 was made by observing the state of fusing on the blade after a durability test (i.e., continuous agitation for two hours) conducted by using a developing device of the Phaser 740J.

TABLE 1

| | Fixing strength (%) | | | Non-offset range (° C.) | Print durability | | | | | | Spent amount (wt. %) and fusing |
|---|---|---|---|---|---|---|---|---|---|---|---|
| | | | | | Initial | | 1,000 sheets | | 50,00 sheets | | |
| | 125° C. | 135° C. | 145° C. | | ID | BG | ID | BG | ID | BG | |
| Ex. 1 | 60.1 | 82.4 | 89.3 | 125–180 | 1.41 | 0.32 | 1.39 | 0.35 | 1.38 | 0.41 | 0.08 |
| Ex. 2 | 62.1 | 85.7 | 90.2 | 125–170 | 1.43 | 0.35 | 1.40 | 0.37 | 1.41 | 0.39 | 0.10 |
| Ex. 3 | 52.1 | 75.5 | 80.9 | 125–185 | 1.40 | 0.41 | 1.41 | 0.40 | 1.39 | 0.38 | 0.05 |
| Ex. 4 | 56.7 | 78.9 | 85.6 | 125–190 | 1.41 | 0.37 | 1.40 | 0.39 | 1.38 | 0.42 | 0.07 |
| Ex. 5 | 58.3 | 80.5 | 87.6 | 125–155 | — | — | — | — | — | — | No fusion |
| C. Ex 1 | Offset | 47.5 | 58.2 | 135–230 | 1.40 | 0.44 | 1.25 | 1.12 | 1.15 | 2.03 | 0.65 |
| C. Ex 2 | Offset | 45.0 | 54.5 | 135–230 | 1.41 | 0.38 | 1.33 | 0.67 | 1.20 | 1.36 | 0.44 |
| C. Ex 3 | — | — | — | — | — | — | — | — | — | — | — |
| C. Ex 4 | 70.6 | 89.2 | Offset | 125–135 | — | — | — | — | — | — | — |
| C. Ex 5 | — | — | — | None of non offset range | — | — | — | — | — | — | Fusing was observed |

As shown in Table 1, it is obvious that the toner for electrophotography of the present invention obtained in Examples 1–5 has a fixing strength of more than 75% when the roll temperature is 135° C., and substantially the same image property as for the first copy was obtained even after the 50,000 sheets of copying for Examples 1–4.

On the other hand, in Comparative Examples 1 and 2, the fixing strength is weaker than that of the ones obtained in Examples. Also, a decrease in image density and increase in the background were confirmed after the termination of the 50,000 sheets of copying for Comparative Examples 1 and 2.

Moreover, when the surface of the carrier and a photosensitive member were observed after the termination of the 50,000 sheets of copying process, a large amount of spent toner was occurred in the carrier used in Comparative Examples 1 and 2 and the toner was deposited on the photosensitive member as filming. Such phenomenon was not observed for the carrier and the photosensitive member used for Examples 1–5.

Further, although fusion occurred on the charging blade of developing device of the Phaser 740J, which was used to make an evaluation of the full-color toner, by the continuous agitation for about one hour in Comparative Example 5, this fusing phenomenon did not occur in Example 5 even after the continuous agitation for two hours.

In addition, the toner obtained in Comparative Examples 4 and 5 had no or a very narrow non-offset range and, hence, they were not capable of being subjected to an evaluation process for print durability.

What is claimed is:

1. A toner for electrophotography, comprising:

a polylactic acid type biodegradable resin; and a terpene-phenol copolymer.

2. A toner for electrophotography according to claim 1, wherein the molar fraction of one of L-lactic acid unit and D-lactic acid unit in lactic acid component of said polylactic acid type biodegradable resin is in the range between about 75 mol % and about 98 mol %.

3. A toner for electrophotography according to claim 1, wherein said terpene-phenol copolymer comprises at least one composition selected from the group consisting of:

(a) cyclic terpene-phenol copolymer, prepared by copolymerizing cyclic terpene and phenol;

(b) cyclic terpene/phenol (1:2 molar ratio) addition product, prepared by adding two molecules of phenol to one molecule of cyclic terpene;

(c) polycyclic terpene/phenol (1:2 molar ratio) addition product, prepared by a condensation reaction of a cyclic terpene/phenol (1:2 molar ratio) addition product with one of aldehyde and ketone; and (d) polycyclic terpene/phenol (1:1 molar ratio) addition product, prepared by a condensation reaction of a cyclic terpene/phenol (1:1 molar ratio) addition product with one of aldehyde and ketone.

4. A toner for electrophotography according to claim 2, wherein said terpene-phenol copolymer comprises at least one composition selected from the group consisting of:

(a) cyclic terpene-phenol copolymer, prepared by copolymerizing cyclic terpene and phenol;

(b) cyclic terpene/phenol (1:2 molar ratio) addition product, prepared by adding two molecules of phenol to one molecule of cyclic terpene;

(c) polycyclic terpene/phenol (1:2 molar ratio) addition product, prepared by a condensation reaction of a cyclic terpene/phenol (1:2 molar ratio) addition product with one of aldehyde and ketone; and (d) polycyclic terpene/phenol (1:1 molar ratio) addition product, prepared by a condensation reaction of a cyclic terpene/phenol (1:1 molar ratio) addition product with one of aldehyde and ketone.

5. A toner for electrophotography according to claim 1, wherein the ratio of said polylactic acid type biodegradable resin with respect to said terpene-phenol copolymer is in the range between about 80:20 and about 20:80.

6. A toner for electrophotography according to one of claims 1–5, wherein the melting start temperature of said toner is about 110° C. or lower.

7. A full-color toner, comprising:

a polylactic acid type biodegradable resin; and a terpene-phenol copolymer.

8. A full-color toner according to claim 7, wherein the molar concentration of one of L-lactic acid unit and D-lactic acid unit in a lactic acid component of said polylactic acid type biodegradable resin is in the range between about 75 mol % and about 98 mol %.

9. A full-color toner according to claim 7, wherein said terpene-phenol copolymer comprises at least one composition selected from the group consisting of:

(a) cyclic terpene-phenol copolymer, prepared by copolymerizing cyclic terpene and phenol;

(b) cyclic terpene/phenol (1:2 molar ratio) addition product, prepared by adding two molecules of phenol to one molecule of cyclic terpene;

(c) polycyclic terpene/phenol (1:2 molar ratio) addition product, prepared by a condensation reaction of a cyclic terpene/phenol (1:2 molar ratio) addition product with one of aldehyde and ketone; and (d) polycyclic terpene/phenol (1:1 molar ratio) addition product, prepared by a condensation reaction of a cyclic terpene/phenol (1:1 molar ratio) addition product with one of aldehyde and ketone.

10. A full-color toner according to claim 7, wherein the ratio of said polylactic acid type biodegradable resin with respect to said terpene-phenol copolymer is in the range between about 80:20 and about 20:80.

11. A fill-color toner according to claim 7, wherein the melting start temperature of said toner is about 110° C. or lower.

* * * * *